US006382300B2

(12) United States Patent
Lee et al.

(10) Patent No.: US 6,382,300 B2
(45) Date of Patent: May 7, 2002

(54) CASTING HAVING AN ENHANCED HEAT TRANSFER, SURFACE, AND MOLD AND PATTERN FOR FORMING SAME

(75) Inventors: Ching Pang Lee, Cincinnati, OH (US); Wayne Charles Hasz, Pownal, VT (US); Nesim Abuaf, Schenectady, NY (US); Robert Alan Johnson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/863,185

(22) Filed: May 24, 2001

Related U.S. Application Data

(62) Division of application No. 09/480,358, filed on Jan. 10, 2000, now Pat. No. 6,302,185.

(51) Int. Cl.[7] ..... B22C 7/00; B22C 9/02

(52) U.S. Cl. ..... 164/246; 164/235; 164/45; 164/35; 164/516

(58) Field of Search ..... 164/246, 235, 164/45, 34, 35, 516; 249/61

(56) References Cited

U.S. PATENT DOCUMENTS 4,101,691 A * 7/1978 Borchert ..... 427/229
4,139,046 A * 2/1979 Stanciu ..... 164/45
4,417,381 A * 11/1983 Higginbotham ..... 29/156.8 H
4,421,153 A * 12/1983 Wilkinson et al. ..... 164/35
4,434,835 A * 3/1984 Willgoose ..... 164/34
4,744,725 A * 5/1988 Matarese et al. ..... 415/172 A
5,524,695 A * 6/1996 Schwartz ..... 164/34
5,641,014 A * 6/1997 O'Connor et al. ..... 164/516
5,681,661 A * 10/1997 Kelly ..... 428/601
5,746,272 A * 5/1998 Mastrorio et al. ..... 164/516
5,921,309 A * 7/1999 Nishida et al. ..... 164/35
5,960,249 A * 9/1999 Ritter et al. ..... 419/6
5,975,850 A * 11/1999 Abuaf et al. ..... 416/97 R
5,983,982 A * 11/1999 Vihtelic et al. ..... 164/516
6,142,734 A * 11/2000 Lee ..... 416/97 R
6,302,185 B1 * 10/2001 Lee et al. ..... 164/45

* cited by examiner

*Primary Examiner*—M. Alexandra Elve
*Assistant Examiner*—Kevin P. Kerns
(74) *Attorney, Agent, or Firm*—Patrick K. Patnode; Christian G. Cabou

(57) ABSTRACT

A casting includes a heat transfer surface having a plurality of cavities. The plurality of cavities include a density of at least about 25 cavities per square centimeter to about 1,100 cavities per square centimeter resulting in increased surface area and therefore enhanced heat transfer capability. Also disclosed is a mold for forming a pattern for molding the casting. The mold includes a surface defining a portion of a chamber to which are attached a plurality of particles having an average particle size in a range of about 300 microns to about 2,000 microns.

7 Claims, 3 Drawing Sheets

CASTING HAVING AN ENHANCED HEAT TRANSFER, SURFACE, AND MOLD AND PATTERN FOR FORMING SAME

This application is a division of application Ser. No. 09/480,358, filed Jan. 10, 2000, now U.S. Pat. No. 6,302, 185, which is hereby incorporated by reference in its entirety.

BACKGROUND OF THE INVENTION

This invention relates to parts that require surface roughness such as metal components used in turbine engines and more specifically to enhancing the heat transfer properties of various surfaces of the parts.

Various techniques have been devised to maintain the temperature of turbine components below critical levels. For example, coolant air from the engine compressor is often directed through the component, along one or more component surfaces. Such flow is understood in the art as backside air flow, where coolant air is directed at a surface of an engine component that is not directly exposed to high temperature gases from combustion. In combination with backside air flow, projections from the surface of the component have been used to enhance heat transfer. These projections or bumps increase the surface area of a part and thus increase heat transfer with the use of a coolant medium that is passed along the surface. The projections are formed by one of several techniques including wire spraying and casting.

SUMMARY OF THE INVENTION

There is a need for castings and methods for forming castings with heat transfer surfaces having increased surface areas for enhanced heat transfer performance. The above mentioned need is satisfied in the present invention in which one embodiment includes a casting having a heat transfer surface having a plurality of cavities. The cavities desirably have a density in the range of about 25 particles per square centimeter to about 1,100 particles per square centimeter and an average depth less than about 300 microns to about 2,000 microns.

Another embodiment of the present invention includes a mold for forming a pattern for use in molding a casting having a heat transfer surface. The mold includes a first mold portion and a second mold portion defining a chamber for molding the pattern. A plurality of particles are attached to a portion of the first mold portion defining the chamber. The plurality of particles have a density desirably in the range of about 25 particles per square centimeter to about 1,100 particles per square centimeter and an average particle size in the range of about 300 microns to about 2,000 microns.

Another embodiment of this invention includes a pattern for forming a casting having an enhanced heat transfer surface. This pattern corresponds to the casting and has a surface portion having a plurality of cavities similar to the casting as noted above.

Further embodiments of the present invention include a method for forming the casting described above and a method for forming the pattern described above.

Yet another embodiment of the present invention includes a method for forming a mold for use in molding the pattern for use in forming the casting described above. The method includes providing a mold having a first mold portion and a second mold portion defining a chamber for forming the pattern, and attaching a plurality of particles to a portion of the first mold portion defining the chamber. The plurality of particles comprise a density in the range of about 25 particles per square centimeter to about 1,100 particles per square centimeter and an average particle size in the range of about 300 microns to about 2,000 microns.

DETAILED DESCRIPTION OF THE INVENTION

Figure 1:
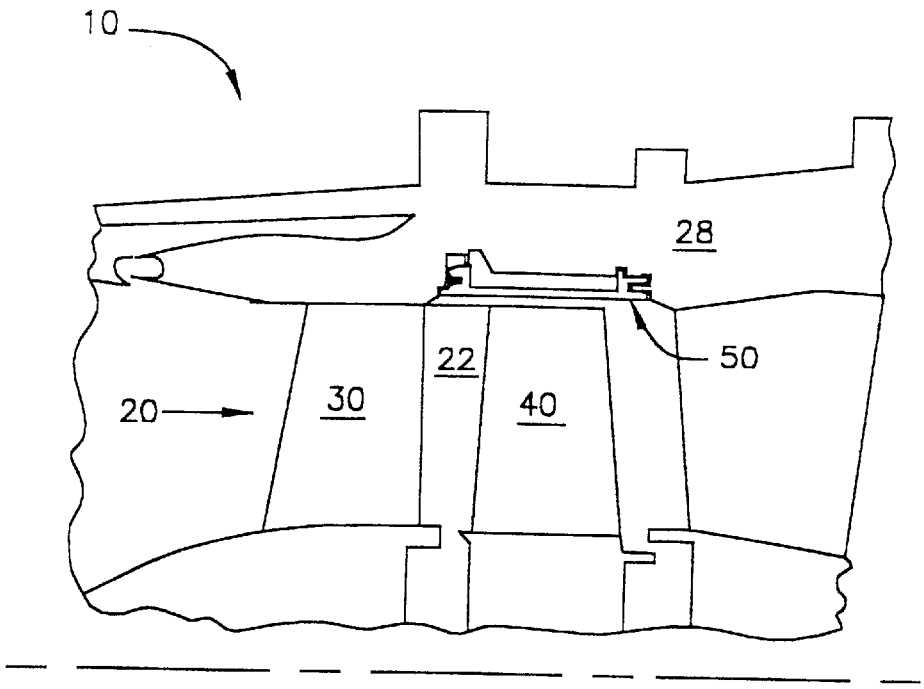
FIG. 1 is a partial, longitudinal cross-sectional view of a turbine in which the turbine is generally symmetrical about a center line.
Figure 2:
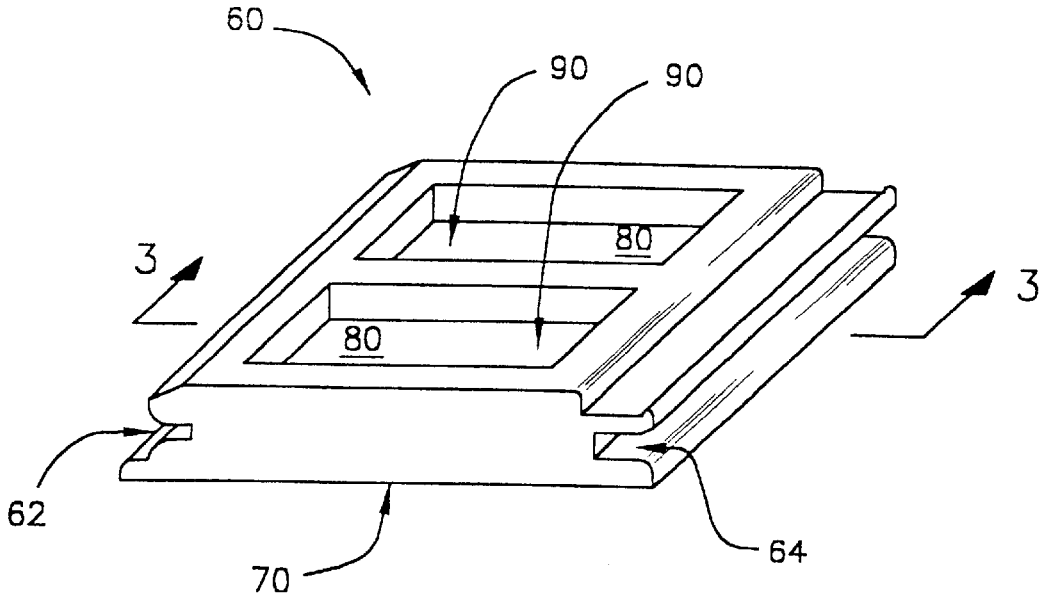
FIG. 2 is an enlarged, perspective view of a turbine shroud section of the present invention shown in FIG. 1.

FIG. 1 illustrates a longitudinal cross-sectional view of a portion of a turbine 10 in which a flow of gas 20 passes through an interior portion 22 of turbine 10. A plurality of nozzles 30 direct gas flow 20 and a plurality of buckets 40 capture gas flow 20 to turn a shaft. A turbine shroud 50 encircles buckets 40 separating interior portion 22 from an exterior portion 28. A plurality of turbine shroud sections or castings 60, one of which is illustrated in FIG. 2, typically form turbine shroud 50. Casting 60 has an inner surface 70 which is disposed adjacent to buckets 40 and an enhanced heat transfer surface 80 disposed at a bottom of a depression 90.

In exemplary turbine 10, interior portion 22 of turbine 10 can reach temperatures exceeding 2,000 degrees Fahrenheit. To prevent deformation of the turbine shroud, it is desirable to maintain the turbine shroud at a temperature in a range of 1,400–1,600 degrees Fahrenheit.

Figure 3:
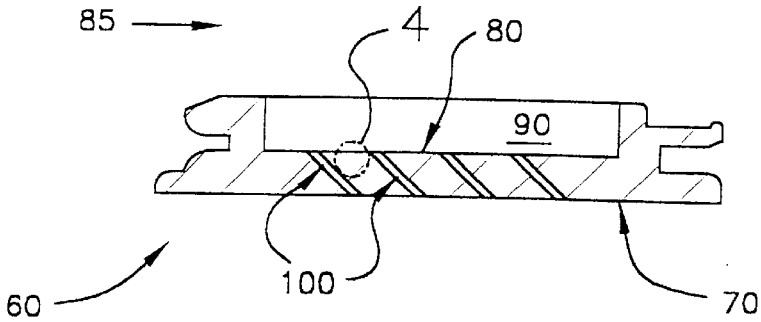
FIG. 3 is a cross-sectional view taken along line 3—3 of FIG. 2.

As shown in FIG. 3, casting 60 includes holes or passageways 100 which aid in cooling casting 60 via a flow of compressed air 85. The compressed air 85 absorbs heat from heat transfer surface 80 prior to passing through holes 100 in the turbine shroud section.

To further enhance the absorption of heat from casting 60, heat transfer surface 80 has an increased surface area. The increased surface area is accomplished by roughening of the surface during the process of molding the casting. Increasing the cooling surface area of turbine shroud increases performance of the turbine, and by reducing the temperature of the turbine shroud, its useful life is also prolonged.

Figure 4:
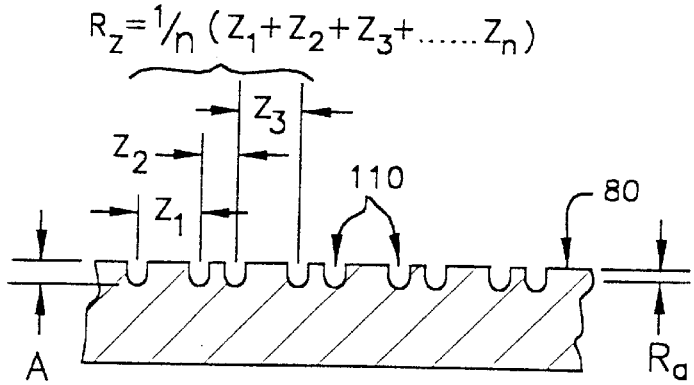
FIG. 4 is an enlarged view of detail 4 of FIG. 3 illustrating a heat transfer surface of the casting having a plurality of cavities.

As best shown in FIG. 4, a portion of heat transfer surface 80 comprises a plurality of cavities 110 of depth A for increasing the surface area which are formed and described in greater detail below.

Figure 5:
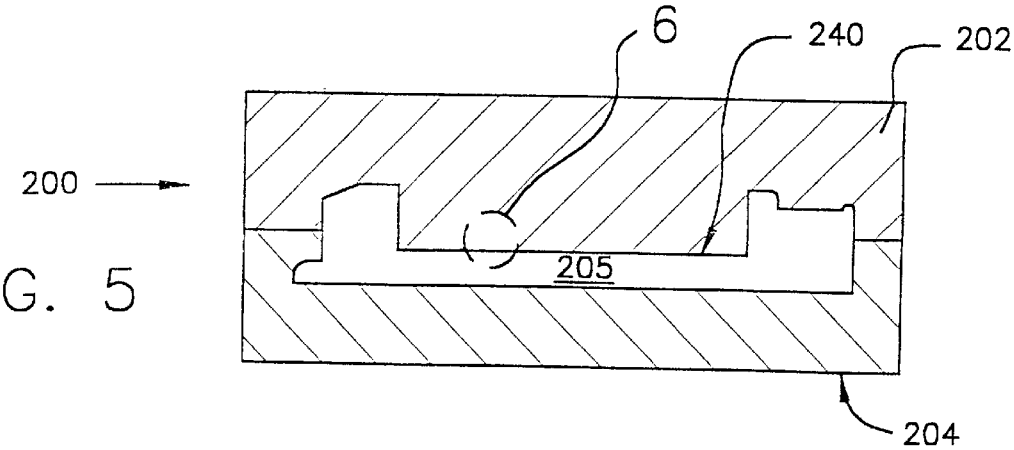
FIG. 5 is a cross-sectional view of a mold of the present invention having a chamber for molding a pattern for use in molding the turbine shroud section shown in FIG. 2.
Figure 7:
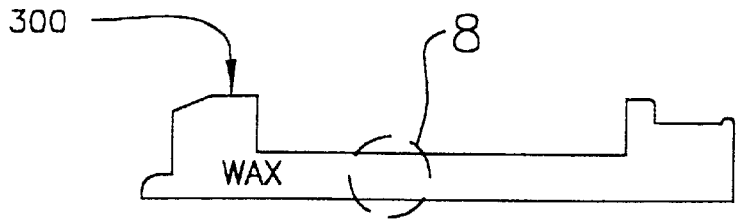
FIG. 7 is a cross-sectional view of a pattern molded using the mold of FIG. 5.

With reference to FIG. 5, FIG. 5 illustrates a die or mold 200 of the present invention for molding a pattern 300 (FIG. 7) for use in molding casting 60 having heat transfer surface 80. Mold 200 includes a first mold portion 202 and a second mold portion 204 which define a hollow chamber 205 for molding pattern 300 (FIG. 7).

Figure 6:
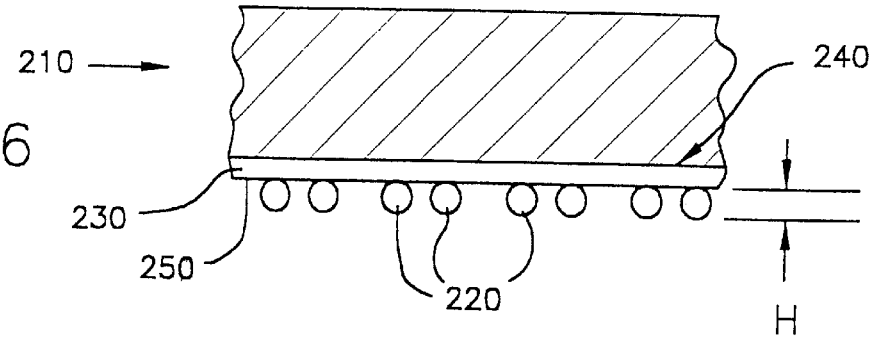
FIG. 6 is an enlarged view of detail 6 of FIG. 5 illustrating a plurality of particles extending from a surface of the mold defining the chamber.

A portion 210 of first mold portion 202, best shown in FIG. 6, includes turbulation material such as a plurality of particles 220 of height H attached to a surface portion 240. The plurality of particles 220 defines a roughened surface that is effective to create a roughened surface on pattern 300 (FIG. 7) as explained below.

The plurality of particles 220 have a density of at least about 25 particles per square centimeter, and an average particle size of size less than about 2,000 microns. In one embodiment, the plurality of particles 220 has a density of at least about 100 particles per square centimeter, and an average particle size of less than about 1,000 microns. In another embodiment, the plurality of particles 220 desirably has a density of at least about 1,100 particles per square centimeter and an average particle size of less than about 300 microns.

The plurality of particles 220 may be attached to portion 210 of first mold portion 202 by brazing using a sheet of commercially available green braze tape 230. Green braze tape 230 includes a first side 250 having an adhesive and an opposite non-adhesive side which is applied to surface 240 of portion 210 of mold 200. The plurality of particles 220 is then spread on adhesive surface 250, followed by a spraying of solvent on top of particles 220. The solvent such as an organic or water-based solvent is used to soften braze sheet 230 to insure a good contact between surface 240 of portion 210 of mold 200 and braze sheet 230. Portion 210 of first mold portion 202 is then heated to braze the plurality of particles onto surface 240 to form a roughened surface. Suitable particles and processes for attaching the particles to a surface are disclosed in U.S. patent application Ser. No. 09/304,276, filed May 3, 1999 and entitled Article Having Turbulation And Method of Providing Turbulation On An Article, the entire subject matter of which is incorporated herein by reference.

The size and shape as well as the arrangement of particles 220 on mold 200 can be adjusted to provide maximum heat transfer for a given situation. The figures show generally spherical particles, but these could be other shapes such as cones, truncated cones, pins or fins. The number of particles per unit area will depend on various factors such as their size and shape. Desirably, mold 200, the plurality of particles 220, and the braze alloy of the braze tape are formed from similar metals.

After attachment of the plurality of particles 220 to mold 202, mold 220 can be used in a conventional casting process to produce pattern 300 as shown in FIG. 7. Pattern 300 will have a roughened surface texture which is the mirror image of mold 200.

Figure 8:
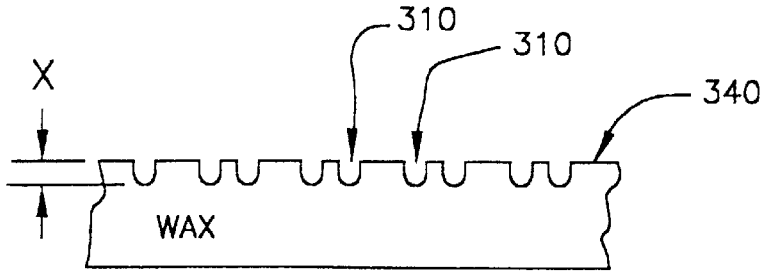
FIG. 8 is an enlarged view of detail 8 of FIG. 7 illustrating a surface of the pattern having a plurality of cavities.

In an example of a conventional casting process, mold 200 (FIG. 5) is filled with liquid wax which is allowed to harden resulting in pattern 300 which corresponds to casting 60 (FIGS. 2 and 3). This pattern 300 includes the roughened surface 340 comprising cavities 310 of depth X formed by the plurality of particles 220, as best shown in FIG. 8. These cavities have an average depth of less than about 2,000 microns, and desirably less than about 1,000 microns and most desirably less than about 300 microns. For spherical particles, the plurality of cavities 310 correspond respectively to a density of at least about 25 particles per square centimeter, a density of at least about 100 particles per square centimeter, and a density of at least about 1,100 particles per square centimeter.

Figure 9:
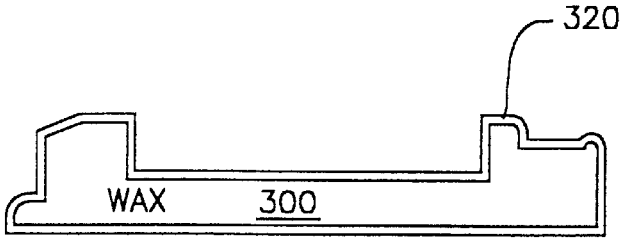
FIG. 9 is a cross-sectional view similar to FIG. 7 in which the wax pattern includes a ceramic shell.

As shown in FIG. 9, a ceramic shell 320 is desirably added to pattern 300. Pattern 300 with ceramic shell 320 is then used in a conventional investment casting process by being placed inside a sand mold surrounded by casting sand. The sand mold is then heated above the melting point of the wax pattern resulting in the wax exiting the sand mold through an outlet. Casting material, for example, liquid metal is then introduced into the sand mold and, in particular, into ceramic shell 320 via an inlet and allowed to harden. The molded casting 60 is then removed from the sand mold and ceramic shell 320 is cleaned off along with any extraneous metal formed in the inlet and the outlet to the ceramic shell. Also, machining is necessary to form a groove 62 and a groove 64 as best shown in FIG. 2. Desirably, the metal is an alloy such as a heat resistant alloy designed for high temperature environments.

With reference again to FIG. 4, casting 60 will have a heat transfer surface 80 with a plurality of cavities 110 which corresponds to pattern 300. For example, the plurality of cavities 110 in casting 60 has an average depth of less than about 2,000 microns, and desirably less than about 1,000 microns and most desirably less than about 300 microns. For spherical particles (500 microns in diameter), the plurality of cavities 310 corresponds, respectively, to a density of at least 25 particles per square centimeter (e.g., an enhanced surface area $A/A_O$ of about 1.10), a density of at least 100 particles per square centimeter (e.g., an enhanced surface area of about 1.39), and a density of at least about 1,100 particles per square centimeter (e.g., an enhanced surface area of about 2.57).

The size of the plurality particles 220 is determined in large part by the desired degree of surface roughness, surface area and heat transfer. Surface roughness can also be characterized by the centerline average roughness value Ra, as well as the average peak-to-valley distance Rz (e.g., $R_z = 1/n\ (Z_1+Z_2+Z_3+\ .\ .\ .\ Z_n)$) in a designated area as measured by optical profilometry as shown in FIG. 4. For example, Ra is within the range of 2–4 mils (50–100 microns). Similarly, according to an embodiment, Rz is within a range of 12–20 mils (300–500 microns).

From the present description, it will be appreciated by those skilled in the art that the pattern may comprise ceramic for use in molding hollow castings such as turbine airfoils, etc. Accordingly, the various parts which may be formed by the present invention include, combustion liners, combustion domes, buckets or blades, nozzles or vanes as well as turbine shroud sections.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A wax pattern for use in molding a casting having a heat transfer surface, said pattern comprising a surface portion having a plurality of cavities for molding the heat transfer surface of the casting, said surface portion of said pattern corresponding to said heat transfer surface of said casting and wherein said plurality of cavities comprises a density of at least 25 cavities per square centimeter.

2. The pattern of claim 1 wherein said plurality of cavities comprises a depth of less than about 2,000 microns.

3. The pattern of claim 1 wherein said density comprises at least about 100 cavities per square centimeter.

4. The pattern of claim 3 wherein said plurality of cavities comprise a depth of less than about 1,000 microns.

5. The pattern of claim 1 wherein said density comprises at least about 1,100 cavities per square centimeter.

6. The pattern of claim 5 wherein said plurality of cavities comprise a depth of less than about 300 microns.

7. The pattern of claim 1 wherein said wax pattern comprises as outer ceramic shell.

* * * * *